United States Patent [19]

Fukasawa

[11] Patent Number: 4,686,340

[45] Date of Patent: Aug. 11, 1987

[54] INDUCTION HEATING APPARATUS WITH UNSUITABLE LOAD DETECTING CIRCUIT

[75] Inventor: Minoru Fukasawa, Otsu, Japan

[73] Assignee: Sanyo Electric Co., Ltd., Moriguchi, Japan

[21] Appl. No.: 850,273

[22] Filed: Apr. 10, 1986

[30] Foreign Application Priority Data

| | | | |
|---|---|---|---|
| Apr. 17, 1985 | [JP] | Japan | 60-81811 |
| Oct. 18, 1985 | [JP] | Japan | 60-160124[U] |
| Oct. 19, 1985 | [JP] | Japan | 60-234311 |

[51] Int. Cl.[4] ..... H05B 6/06

[52] U.S. Cl. ..... 219/10.77; 219/10.49 R; 363/97

[58] Field of Search ..... 219/10.77, 10.49 R; 363/97, 21; 323/300, 275, 277

[56] References Cited

U.S. PATENT DOCUMENTS

| | | | |
|---|---|---|---|
| 4,145,592 | 3/1979 | Mizukawa et al. | 219/10.77 X |
| 4,320,273 | 3/1982 | Kiuchi | 219/10.49 R |
| 4,356,371 | 10/1982 | Kiuchi et al. | 219/10.77 |
| 4,438,311 | 3/1984 | Tazima et al. | 219/10.49 R |
| 4,540,866 | 9/1985 | Okuda | 219/10.77 |

*Primary Examiner*—Philip H. Leung

*Attorney, Agent, or Firm*—Wenderoth, Lind & Ponack

[57] ABSTRACT

An electromagnetic induction heating apparatus having a detecting circuit for detecting an unsuitable load thereof, which detects an input AC power and an exciting current for an inverter so that the levels thereof are compared with each other to discriminate whether or not the load is suitable and it is possible to discriminate the load with accuracy regardless of the height of set level for the input power and current intensity of the detected exciting current, is biased, thereby raising the unsuitable load detection accuracy when oscillation starts.

11 Claims, 26 Drawing Figures

INDUCTION HEATING APPARATUS WITH UNSUITABLE LOAD DETECTING CIRCUIT

BACKGROUND OF THE INVENTION

1. Field of the Invention

The present invention relates to an induction heating apparatus, and more particularly to an induction heating apparatus being provided with an unsuitable load detecting circuit and used for household cooking.

2. Description of the Prior Art

The induction heating apparatus cause a high frequency current to flow through an induction heating coil provided at an inverter to generate a high frequency alternating magnetic field, thereby induction heating a load to be heated, such as an iron cooking iron utensil disposed in proximity to the induction heating coil for cooking the load or foods in the utensil.

In a case where an object to be heated, i.e., the load, is unsuitable, in other words, a smaller object, such as a spoon or a knife, or a pan of special stainless steel (18-8), is placed in proximity to the induction heating coil, an unsuitable load detecting circuit is required for deenergizing the induction heater by the reason that such low impedance load is unsuitable.

The unsuitable load detecting circuit has been well-known (disclosed in the Japanese Patent Publication No. 53-44061 (1978)) which is deenergized by the reason that when the load is a smaller object, an input power does not reach a certain percentage of the set value as compared with an input alternating current. Such apparatus ensures the unsuitable load detection when the setting input power is high; however, differences according to the load are smaller when the input power is low, whereby a reliable detection is difficult. Next, the reason for the above will be explained in accordance with FIG. 1.

FIG. 1 is a graph showing a relationship between the setting value of input power (on the abscissa axis) and the input AC power (on the ordinate axis) with regard to four kinds of loads, in which ① represents the characteristic of a porcelain enameled pan of 200 mm in diameter, ② represents that of a porcelain enameled pan of 120 mm in diameter, ③ represents that of a pan of stainless steel (18-8) of 110 mm in diameter and 1.1 mm in thickness, and ④ represents that of a pan of stainless steel (18-8) of 200 mm in diameter and 2.0 mm in thickness. Since the porcelain enameled pan represented by ② is smaller in diameter, the equivalent inductance viewed from an inverter circuit of the induction heating coil giving such load is larger to result in a large resonance frequency. Hence, when the input setting value is larger, the compensating operation of a frequency limit circuit makes it impossible to obtain an input coincident with the setting value. Since characteristics of the pans of stainless steel (18-8) represented by the lines ③ and ④ are smaller in a resistance component in the equivalent impedance of the induction heating coil giving such loads, an input lower than that of the porcelain enameled pan is obtainable.

As seen from FIG. 1, in a case when the pan of stainless steel (18-8) is intended to be detected as an unsuitable load, a threshold level for determining that the load is a smaller object, is set between the bent lines ② and ③, but in the low setting value region, the characteristics are close to each other, so that it is impossible to recognize the stainless steel pan as the unsuitable one. Since there also is the characteristic of the bent line as shown in ②, in order to decide whether or not the load ② is suitable, it is necessary to previously set the threshold level to be a bent line similar to the line ②, whereby complicated circuitry is inevitable. The input power change follows variations of the source voltage, thereby creating the problem in that the reliable detection is difficult.

SUMMARY OF THE INVENTION

A first object of the present invention is to provide an induction heating apparatus which compares an input AC power with an exciting current for an inverter circuit so as to enable an exact decision as to whether or not the load is suitable on the basis of the comparison result but not in accordance with the level of the input setting value or a value of actual input power.

A second object of the present invention is to provide an induction heating apparatus which is adapted to enable an exact decision as to whether or not the load is suitable regardless of variations in the source voltage.

A third object of the present invention is to provide an induction heating apparatus which biases a detected value of the exciting current so as to have a high accuracy for the unsuitable load detection when the oscillation starts.

A fourth object of the present invention is to provide an induction heating apparatus which uses the exciting current not only for unsuitable load detection but also for overcurrent detection so as to intend overcurrent protection.

The above and further objects and features of the invention will more fully be apparent from the following detailed description with accompanying drawings.

DETAILED DESCRIPTION OF THE PREFERRED EMBODIMENTS

Figure 2:
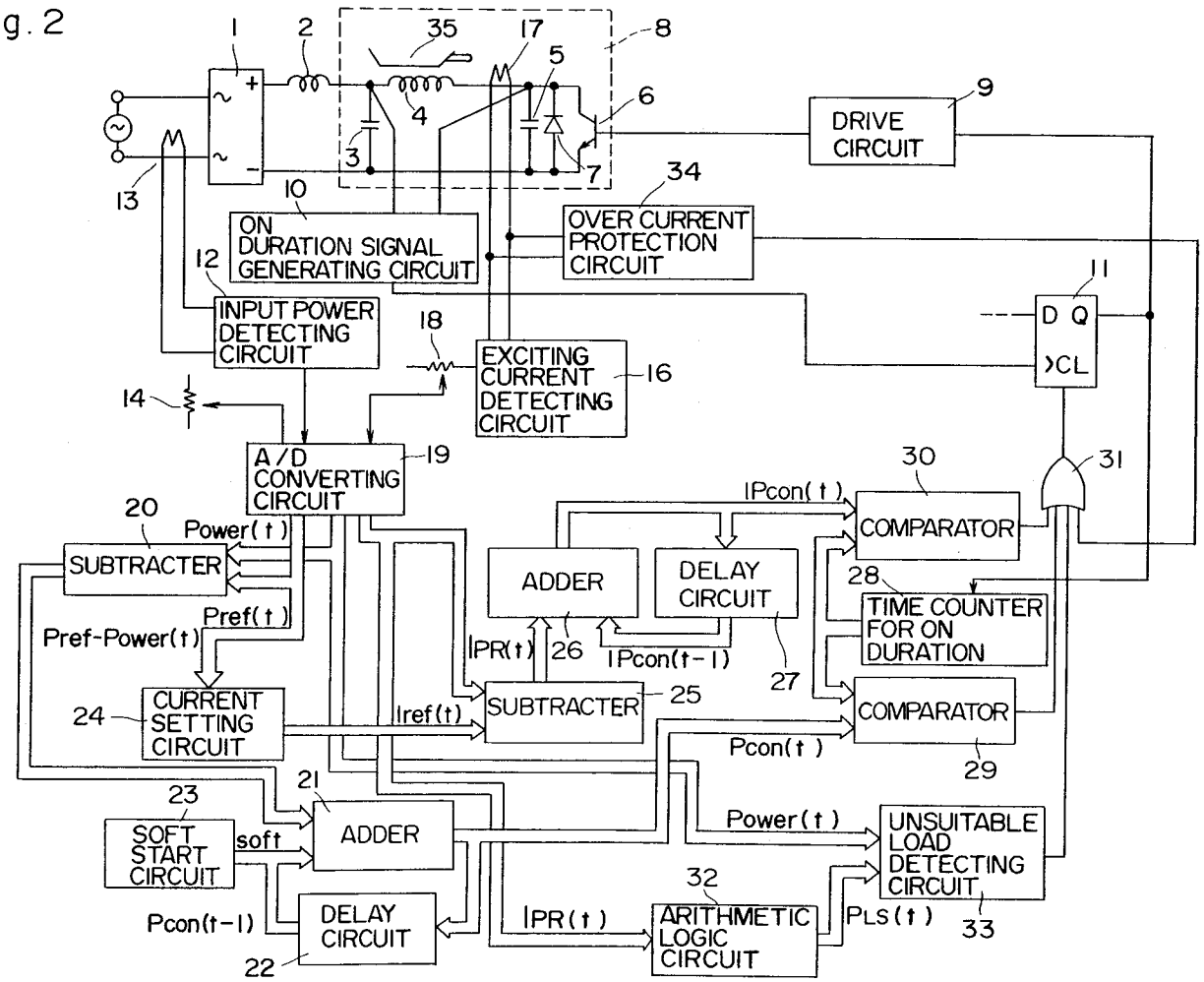
FIG. 2 is a block diagram of a first embodiment of an induction heating apparatus of the present invention.

Referring to FIG. 2, reference numeral 1 designates a full-wave rectifying circuit which receives commercial AC voltage and full-wave rectifies it; numeral 2 designates a choke coil connected to the output terminal of the full-wave rectifying circuit 1; numeral 3 designates a filter capacitor connected to the choke coil 2; numeral 4 designates an induction heating coil connected to the choke coil 2; numeral 5 designates a resonance capacitor constituting a resonance circuit together with the induction heating coil 4; numeral 6 designates a switching transistor connected in parallel with the resonance capacitor 5; numeral 7 designates a damper diode connected in an anti-parallel fashion to the switching transistor 6; and the filter capacitor 3, induction heating coil 4, resonance capacitor 5, switching transistor 6 and damper diode 7, form an inverter circuit 8. Reference numeral 9 designates a drive circuit for ON-OFF-controlling the switching transistor 6 and supplying the base voltage thereto; numeral 10 designates an ON duration signal generating circuit which compares voltages across both terminals of the induction heating coil 4, and which detects the ON timing of the switching transistor 6, and which feeds to a D-flip flop 11 an ON duration signal defining the ON duration of the switching transistor 6 so that the D-flip flop 11 gives its set output through the ON duration signal to the drive circuit 9 to thereby turn on the switching transistor 6; numeral 12 designates an input power detecting circuit which receives a signal from a first current transformer 13 for detecting an input alternating current and outputs an input power level corresponding to the input current; numeral 14 designates operating means for setting the input power, and numeral 16 designates an exciting current detecting circuit connected to a second current transformer 17 for detecting an exciting current in the inverter circuit 8, and for outputting the level signal corresponding to the current intensity of the exciting current, the current transformer 17 being disposed between the negative terminal of the resonance capacitor 5 and the emitter of the switching transistor 6 or the anode of the diode 7.

Reference numeral 18 designates a level adjusting means for adjusting the value of the signal levels from the exciting current detecting circuit 16, the signal levels from the control means 14, input power detecting circuit 12 and exciting current detecting circuit 16, being converted by an A/D converting circuit 19 into digital data Pref, Power and $I_{PR}$ respectively. The cycle period of the A/D conversion is about half of the cycle period of the AC source, and the sampling timing of the A/D conversion is near the crest value of the voltage of the AC source, so that the AC source is provided with a crest value detecting circuit (not shown) to obtain the aforementioned desired cycle period and sampling timing. Thus, the time series data for Pref, Power and $I_{PR}$ are represented by Pref(t), Power(t) and $I_{PR}$(t), and are functions of t: the number showing the order of A/D conversion or the sampling thereof respectively.

Reference numeral 20 designates a subtracter for computing Pref(t)−Power(t) corresponding to the tth A/D conversion timing at the A/D converting circuit 19, and numeral 21 designates an adder which adds the Pref(t)−Power(t) to the data Pcon(t−1) output one cycle before and corresponding to the duration of turning-on the switching transistor 6 to thereby output new ON duration data Pcon(t) which is fed to the input of the adder 21 through a delay circuit 22 and used for adding the subsequent ON duration data Pcon(t+1), in brief, the delay circuit 22 delaying the A/D conversion by one cycle period.

The output Pcon(t) of adder 21 contains a difference between the input power setting value Pref and the actual input value Power(t), which is added to (or subtracted from) the setting value Pcon(t−1) one cycle before by means of the above circuitry. When the induction heating coil 4 starts its energization, in other words, when the inverter circuit 8 initially oscillates, it is preferable to avoid an abrupt increase in current and to gradually increase it. Therefore, during that time, the adder 21 is not fed the output of delay circuit 22 and the output of subtracter 20, and a soft start circuit 23 instead feeds to the adder 21 the soft start data showing the lapse of time corresponding to a gradual current increase pattern, at which time the soft start data is, of course, Pcon(t).

Reference numeral 24 designates a current setting circuit for generating a setting value Iref of the exciting current which increases corresponding to an increase in Pref, that is, the setting input by the operating means 14; numeral 25 designates a subtracter which sequentially computes Iref−$I_{PR}$(t) corresponding to the tth A/D conversion timing at the A/D converting circuit 19, the output of the subtracter 25 representing a difference between the setting current value Iref(t) at the inverter circuit 8 side, determined by the current setting circuit 24 corresponding to the AC input setting value and the actual current $I_{PR}$(t) at the inverter circuit 8 side so that the adder 26 outputs as IPcon (t) the sum of the above difference and one cycle before the output value IPcon (t−1) of the adder 26, the IPcon(t) being fed as the exciting current data to a comparator 30. A delay circuit 27 receives IPcon(t) and delays it by one cycle period for A/D conversion and then feeds the delayed IPcon(t) to the adder 26 for the subsequent addition. In addition, the current value controlled by the exciting current value may be omitted.

Reference numeral 28 designates a counter for ON duration which begins to count clock pulses by the setting output from the D-flip flop 11; numeral 29 designates a comparator which compares the counter value by the time counter for ON duration 28 with aforesaid Pcon(t), and 30 designates a comparator which compares the counted value by the time counter for ON duration 28 with IPcon(t), so that when the compared inputs of either one of comparators 29 or 30 match, the D-flip flop 11 is reset through an OR gate 31 to thereby nullify the output signal to the driver circuit 9 and the time counter for ON duration 28. In other words, the time counter for ON duration 28 times by the count number of clock pulse from the time of turning on the switching transistor 6, but upon reaching the time defined by Pcon(t), that is, the time defined by the setting input value, or the time defined by IPcon(t), that is, the time defined by a setting current value at the inverter 8 side indirectly determined by the setting input value, the switching transistor 6 is turned off so as to enable the desired heating.

Next, an explanation will be given on the construction of the principal portion of the invention.

In FIG. 2, reference numeral 32 designates an arithmetic logic circuit which linearly-transforms the data $I_{PR}$(t) corresponding to the exciting current to thereby compute and output the unsuitable load detecting level $P_{LS}$(t); 33 designates an unsuitable load detecting circuit for comparing the $P_{LS}$(t) with the data Power(t) corresponding to the aforesaid input power, and which resets the D-flip flop 11 through the OR gate 31 when Power(t)<$P_{LS}$(t), and numeral 34 designates an overcurrent protection circuit which detects whether or not the exciting current detected by the second current transformer 17 becomes more than the predetermined value and which, when the overcurrent is detected, resets the D-flip flop 11 through the OR gate 31 that is, when the exciting current exceeds the predetermined percentage to the input power, it stops driving of the inverter circuit 8 because the load is unsuitable.

In such an induction heating apparatus, when oscillation begins in the state where a cooking pan 35, a load to be heated, is disposed in proximity to the induction heating coil 4, at first the ON duration signal generating circuit 10 feeds a signal to the D-flip flop 11. The D-flip flop 11 supplies a set signal to the drive circuit 9 and time counter for ON duration 28 so as to turn on the switching transistor 6, and the time counter for ON duration 28 starts its counting operation so that the counted values are compared with Pcon(t) and Ipcon(t) by the comparators 29 and 30 respectively. In the initial state of oscillation, since the soft start circuit 23 feeds the soft start data Soft at a low level as Pcon(t) to the comparator 29 through the adder 21, when the counted value by the time counter for On duration 28 becomes Soft, the comparator 29 resets the D-flip flop 11 through the OR gate 31, the drive circuit 9 turns off the switching transistor 6, and the time counter for ON duration 28 stops its counting and clears the contents. Thereafter, the resonance of the inverter circuit 8 allows the collector voltage of switching transistor 6 to once rise and fall again. Such a leading edge of the collector voltage is detected by the ON duration signal generating circuit 10 through the inverse voltage across both terminals of induction heating coil 4, thereby feeding the signal to the D-flip flop 11. Hence, the D-flip flop 11 again generates the signal to turn on the switching transistor 6 and the time counter for ON duration 28 starts its counting, thus continuing the oscillation of inverter circuit 8. Simultaneously with the oscillation, the A/D converting circuit 19 is actuated to A/D-convert in a time division manner the set input power value from the operating means 14, the level signal from the input power detecting circuit 12 and the level signal from the exciting current detecting circuit 16 into the digital data Pref(t), Power(t) and $I_{PR}$(t) respectively. In addition, such an A/D conversion, when carried out in units of one duration of the cycle period per half-wave of the commercial alternating current, quickens the time for the input power to coincide with the setting value. The subtracter 20 computes Pref(t)−Power(t) from the data thus A/D converted, and feeds it to the adder 21 in which the Pref(t)−Power(t) is added to the ON duration data Pcon(t−1) fed through the delay circuit 22 one cycle before so as to make the new ON duration data Pcon(t). In other words, the adder 21 sequentially compensates the ON duration data to adjust the length of ON duration so that Power(t) is equal to Pref(t). Accordingly, after the start of oscillation, such function increases the length of ON duration of the switching transistor 6 to make Power(t) equal to Pref(t). Thereafter, the ON duration of such length is maintained. Meanwhile, the subtracter 25 subtracts $I_{PR}$(t) from Iref(t) generated correspondence with Pref(t) so as to compute the data Iref(t)−$I_{PR}$(t) in response to the operation of the A/D converting circuit 19 and give it to the adder 26. The adder 26 adds the data Iref(t)−$I_{PR}$(t) to the one cycle before limit data IPcon(t−1) supplied through the delay circuit 27 to thereby form the new limit data Ipcon(t). In other words, the adder 26 sequentially compensates the limit data Ipcon(t) so as to adjust the ON duration length so that the Iref(t) is equal to $I_{PR}$(t).

In a case of using a cooking utensil of ferromagnetic material, such as iron or enameled porcelain, the resonance current in the inverter circuit 8 is smaller than the input AC power, so that the ON duration data Pcon(t) normally defines the ON duration length of the switching transistor 6. However, in a case of using a cooking utensil of weak-magnetic material, such as stainless steel (18-8), the exciting current in the inverter circuit 8 is relatively larger than the above in comparison with the input AC current, thereby regulating the ON duration length of switching transistor 6 by the limit data Ipcon(t), resulting in the output being substantially controlled by comparing Iref(t) with $I_{PR}$(t). The overcurrent protection circuit 34 detects an overcurrent flowing through the switching transistor 6 when the exciting current within the inverter circuit 8 abruptly increases during the above control or the comparators 29 and 30 do not develop matched output, thereby resetting the D-flip flop 11 to turn off the switching transistor 6 for protection.

Now, in the induction heating apparatus of the present invention, besides the above oscillation, the unsuitable load detecting circuit 33 compares the load discrimination level $P_{LS}$(t) generated by the arithmetic logic circuit 32 in proportion to $I_{PR}$(t) with Power(t) so as to decide that the load is unsuitable when $P_{LS}$(t)>Power(t), thereby resetting the D-flip flop 11. When the load of a small object, such as a knife or a fork, is disposed in proximity to the induction heating coil 4, or a cooking utensil of nonmagnetic material is used, the relationship of $P_{LS}$(t)>Power(t) appears to thereby stop the oscillation of the inverter.

A ratio of Ipr(t) or $P_{LS}$(t) in the linear relation therewith to Power(t), if the loads are the same, is approximately fixed through the entire region of the input power. Hence, even for the soft start duration in which the soft start data Soft controls the ON duration of the switching transistor 6, a determination can be made as to whether or not the load is suitable in the same way as when the ON duration is controlled by the subsequent Pref(t). The conventional apparatus for comparing Pref(t) with Power(t) starts the soft start duration from the predetermined ON duration of the switching transistor 6 regardless of Pref(t), thereby increasing the ON duration. Hence, the Pref(t) and Power(t) often have no relationship therebetween, so it is difficult to discriminate whether or not the load in this time duration is suitable.

Figure 1:
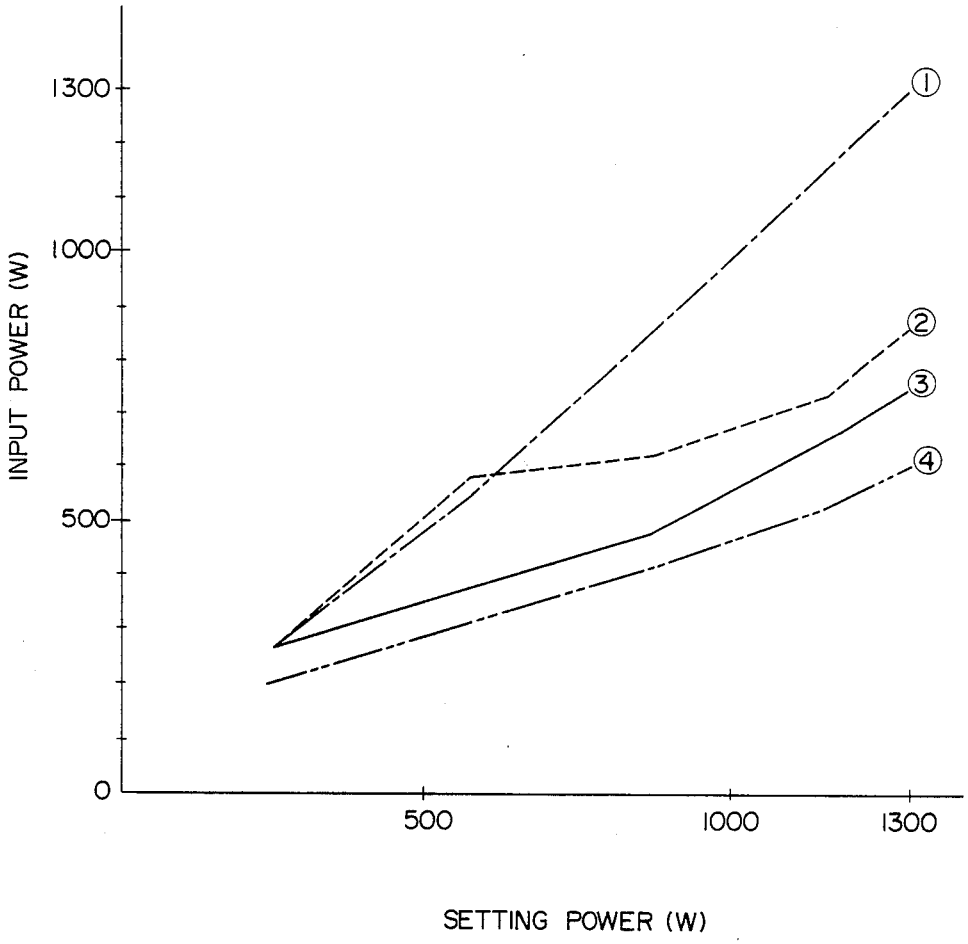
Fig. 1 Prior Art
FIG. 1 is a graph showing the relationship between an input AC power and a setting value of an input power of the conventional apparatus.

As shown in the characteristic ② in FIG. 1, the load of large inductance is not linear in variation of the actual input power value Power(t) with respect to the setting value Pref(t), because in the region where the setting value Pref(t) is at the high level, the off timing of the switching transistor 6 is regulated not by Pcon(t) but by Ipcon(t) or certifying 20 kHz. However, even for such a load, the load discriminating standard can be the straight line but not the bent line.

An explanation will now be given about the loads ① through ④ shown in FIG. 1. The results of measuring the setting value Pref of input power, actual input power value Power and exciting current $I_{PR}$ of inverter circuit 8 are shown in Table 1 and the relationship between the Pref and the Power is shown in FIG. 3.

TABLE 1

| | Pref | | | | | | | | | |
|---|---|---|---|---|---|---|---|---|---|---|
| | 1300w | | 1175w | | 875w | | 575w | | 250w | |
| | Power | IpR | Power | IpR | Power | IpR | Power | IpR | Power | IpR |
| ① Porcelain Enameled Diameter: 200 mm | 1300 | 60 | 1175 | 59 | 875 | 49 | 550 | 35 | 250 | |
| ② Porcelain Enameled Diameter: 120 mm | 805 | 53 | 740 | 50 | 625 | 45 | 575 | 41 | 250 | 24 |
| ③ Stainless Steel (18-8) Diameter: 120 mm Thickness: 1.1 mm | 740 | 56 | 665 | 52 | 475 | 44 | 375 | 40 | 250 | 31 |
| ④ Stainless Steel (18-8) Diameter: 200 mm Thickness: 2.0 mm | 600 | 60 | 525 | 56 | 410 | 51 | 305 | 43 | 200 | 35 |

Figure 3:
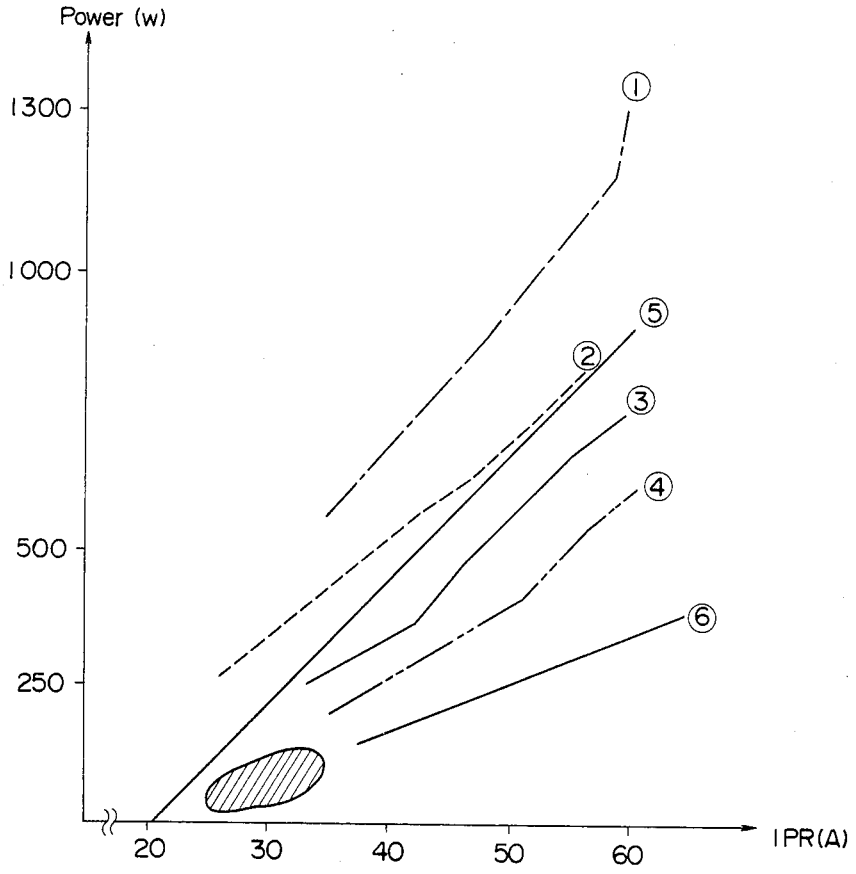
FIG. 3 is a graph showing the relationship between the input AC power and an exciting current flowing through an inverter circuit of the induction heating apparatus of the present invention.

In FIG. 3, the line ⑤ shows a linear conversion relationship between $I_{PR}$ and $P_{LS}$ set by the arithmetic logic circuit 32. In a case where a $P_{LS}$ value computed regarding a certain value of $I_{PR}$ is larger than the Power value, the load is discriminated to be unsuitable to thereby stop driving of the inverter circuit 8. In the conversion characteristic ⑤ shown in FIG. 3, the loads represented by the lines ③ and ④ are positioned below the line ⑤ throughout the entire area of the input power, whereby an unsuitable load is detected throughout the entire region.

An aluminum cooking utensil has the characteristic as shown by the line ⑥ in FIG. 3, so that when the load shown by the line ⑥ is intended to be discriminated as unsuitable and the loads shown by the lines ①, ②, ③ and ④ as suitable, the slope of characteristic of the arithmetic logic circuit 32 and the intercept $I_{PR}$ need only be set so that the conversion characteristic of arithmetic logic circuit 32 is positioned between the loads ④ and ⑥. In addition, the smaller load, such as a spoon or a knife, is disposed in a hatched area shown in FIG. 3 and detectable as an unsuitable load by means of the conversion characteristic ⑤.

Incidentally, the aforesaid $I_{PR}$ intercept is simply adjustable not by the arithmetic logic circuit 32 but by the level adjusting means 18 changing the $I_{PR}$ value.

Even when the source voltage varies, Power and $I_{PR}$ vary in association with each other, thereby being not effected by the voltage variation.

Figure 4:
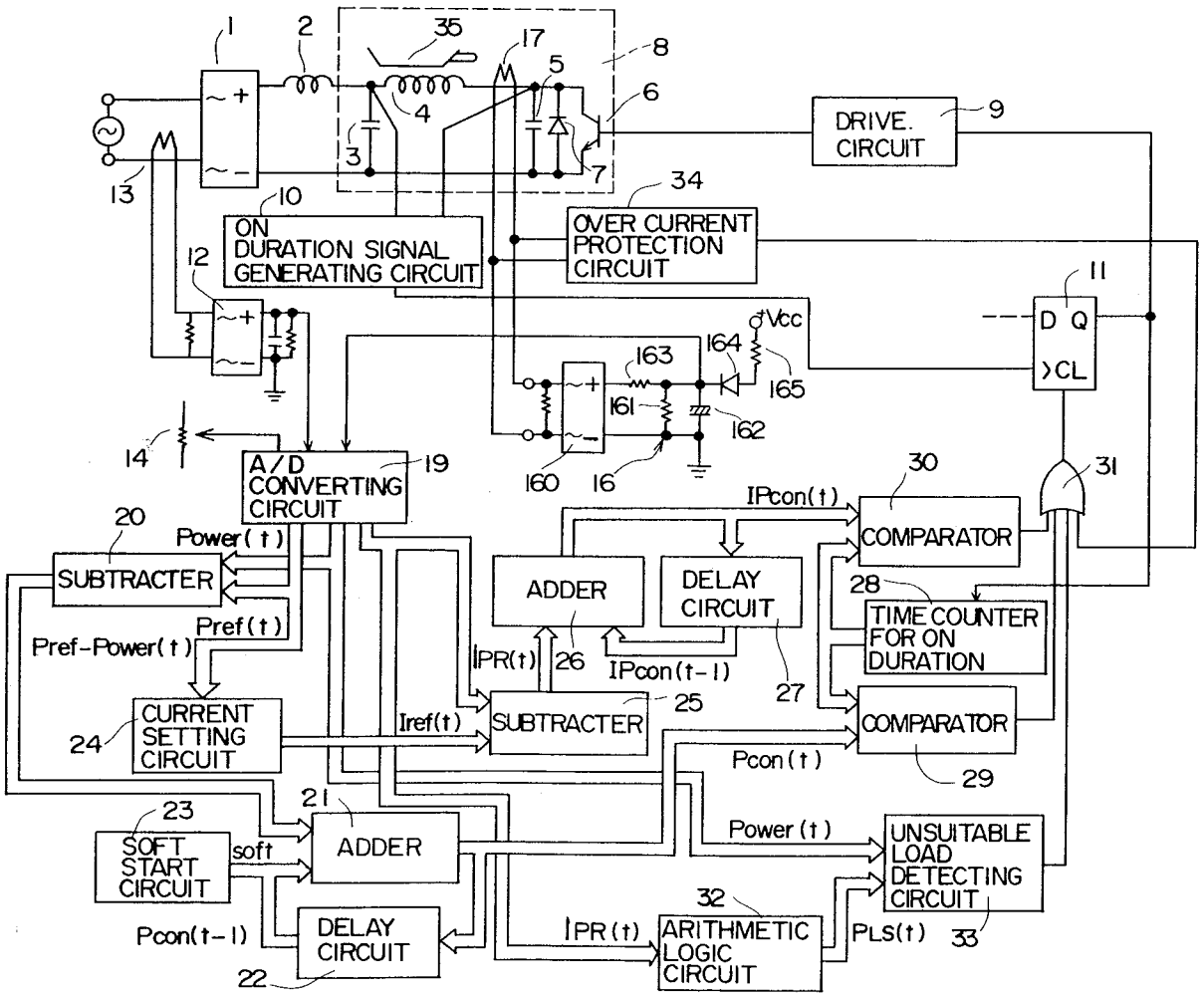
FIG. 4 is a block diagram of a second embodiment of the induction heating apparatus of the invention.
Figure 6:
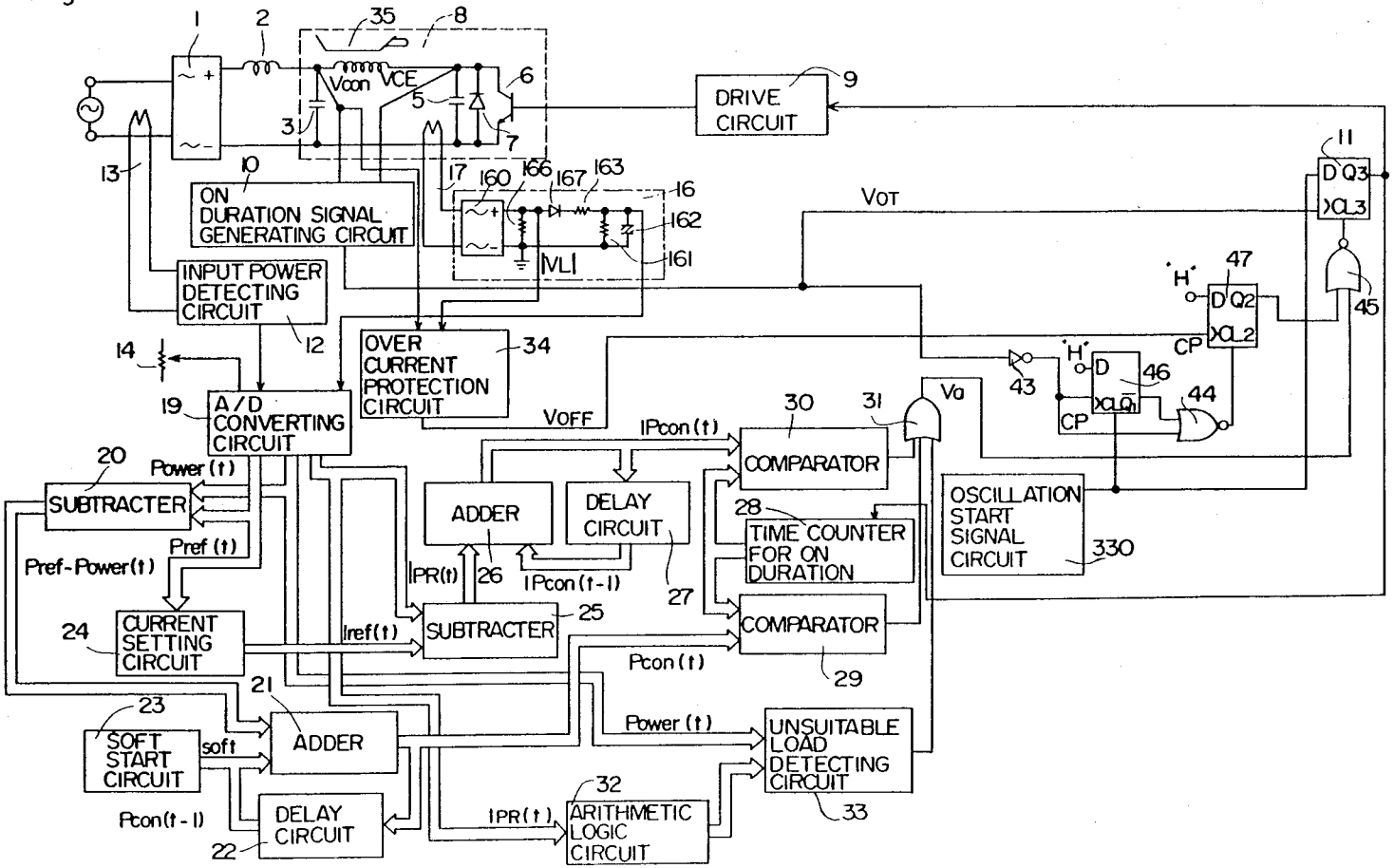
FIG. 6 is a block diagram of a third embodiment of the induction heating apparatus of the present invention.

FIG. 4 shows a second embodiment of the invention, in which a current flowing through the induction heating coil 4 is used as an exciting current for the inverter circuit 8, whereby a current transformer 17 is disposed between the induction heating coil 4 and the positive terminal of resonance capacitor 5. Alternatively, the current transformer 17 may be positioned between the negative terminals of the capacitors 3 and 5 as shown in FIG. 6.

Also, this embodiment is provided with an exciting current detecting circuit 16 comprising a rectifying circuit for full-wave-rectifying the output from the current transformer 17 and a bias circuit for biasing the output voltage from the rectifying circuit. In detail, the output from the current transformer 17 is fed to the full-wave rectifying circuit 160, and between the DC output terminals are connected a series circuit of resistance 163 and a parallel circuit of resistance 161 and smoothing capacitor 162, so that voltage of +Vcc is fed to the positive terminal of the capacitor 162 through a resistance 165 and forward connected diode 164 and the voltage at the positive terminal of capacitor 162 is A/D-converted to thereby obtain $I_{PR}(t)$.

Such construction will improve the unsuitable load detection accuracy at the initial oscillation of the inverter circuit. In addition, the same components shown in FIG. 2 are designated by same reference numbers.

Figure 5:
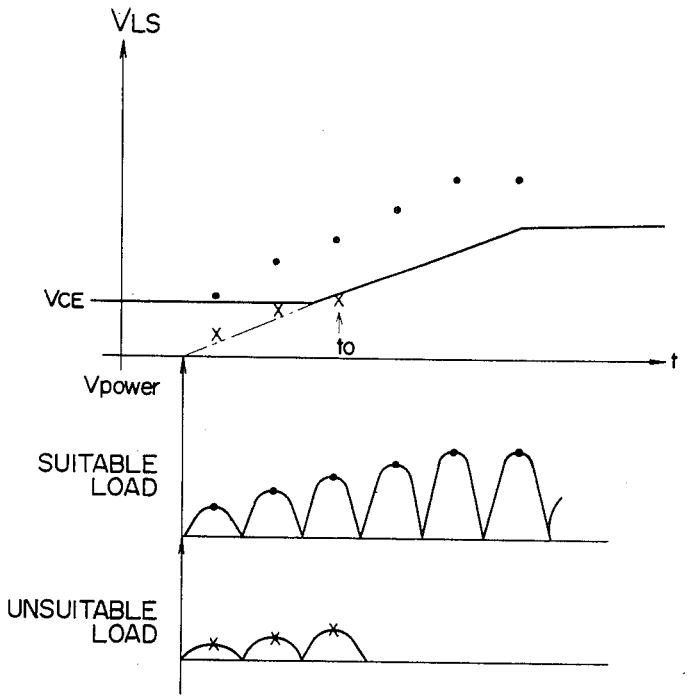
FIG. 5 is an illustration of operation of the second embodiment of the present invention.

Next, explanation will be given on operation of the second embodiment of the invention by reference to FIG. 5. At the lower side in FIG. 5 is shown the full-wave rectifying circuit output Vpower of the input power detecting circuit 12 when the load is suitable and unsuitable. The crest values marked with • and x are sampled to be A/D converted as mentioned above.

At the upper side of FIG. 5 is shown with the straight line voltage at the positive terminal of smoothing capacitor 162 at the exciting current detecting circuit 16, that is, input voltage $V_{LS}$ to the A/D converting circuit 19 and also Vpower detected at the marks • and x are shown.

As seen clearly from FIG. 5, regarding the unsuitable load shown with the mark x, $V_{LS}$ corresponding to $I_{PR}$ (or $P_{LS}$) is larger than Vpower corresponding to Power, thereby enabling the driving of the inverter circuit 8 to be stopped immediately. On the contrary, the suitable load shown with the mark • is larger in Vpower than $V_{LS}$, thereby continuing the driving of inverter circuit 8. In a case of there being no bias of +Vcc, $V_{LS}$ varies as shown with the alternate short and long dashed line in FIG. 5; however, such variation, even when the load is unsuitable makes Vpower larger than $V_{LS}$, resulting in the unsuitable load being detected at the time to when the above magnitude relationship is inverted. Thus, the second embodiment shown in FIG. 4, at the start of oscillation, inhibits the detection of an unsuitable load during the first half-wave duration and makes the unsuitable load detecting circuit 33 detect unsuitable loads from the second half-wave duration, and can detect the unsuitable load exactly in an early stage.

FIG. 6 shows a third embodiment of the induction heating apparatus of the invention, which utilizes the potential at the unsuitable load detecting circuit as before so as to constitute an overcurrent protection circuit 34. In FIG. 6, a current transformer 17 is disposed between the negative terminals of capacitors 3 and 5 and connected to a full-wave rectifying circuit 160 to obtain a DC output.

A resistance 166 is connected between the DC output terminals at the full-wave rectifying circuit 160; a series circuit of a diode 167, a resistance 163 and a resistance 161, is connected in parallel with the resistance 166, and a smoothing capacitor 162 is connected in parallel with the resistance 161. The smoothing capacitor 162, in the same way as the circuit shown in FIG. 4, feeds the potential at its positive terminal to the A/D converting circuit 19. The potential at the node of resistance 166 and diode 167 and that at the positive terminal of full-wave rectifying circuit 1 at the AC power source side (exactly the potential at the node of the choke coil 2 and filter capacitor 3) are supplied to the overcurrent protection circuit 34 which compares both the input voltages so that when the potential at the diode 167 side is higher, a signal $V_{OFF}$ is generated for indicating generation of an overcurrent.

Referring again to FIG. 6, reference numeral 43 designates an inverter; numerals 44 and 45 designate NOR gates, and numerals 46 and 47 designate D-flip flops similar to the aforesaid D-flip flop 11. The terminal D of the flip flop 46 is permanently fed a signal of a high level; the CP terminal of the flip flop 46 is fed an output signal $V_{OT}$ from the ON duration signal generating circuit 10 through the inverter 43; the clear terminal $CL_1$ of the flip flop 46 is fed an oscillation start signal from an oscillation start signal circuit 330, and the output signal from the reset output terminal $\overline{Q}_1$ is fed to one input terminal of the NOR gate 44, the inverter circuit 43 feeding its output to the other input terminal of the NOR gate 44.

The terminal D at the D-flip flop 47 is permanently fed a signal of a high level; the CP terminal of the flip flop 47 is fed the overcurrent signal $V_{OFF}$ from the overcurrent protection circuit 34; the elear terminal $CL_2$ of the flip flop 47 is fed the output signal from the aforesaid NOR gate 44; the set output terminal $Q_2$ of the flip flop 47 supplies its output signal to one input terminal of NOR gate 45, and the other input terminal thereof is fed an output signal Va from the OR gate 31. In the third embodiment, however, the output $V_{OFF}$ of the overcurrent protection circuit 34, in the same way as in the former embodiments, is supplied not to the OR gate 31 but to the CP terminal of the D-flip flop 47. The terminal D of the D-flip flop 11 is fed the oscillation start signal from the oscillation start signal circuit 330, the CP terminal being given the output signal $V_{OT}$ from the ON duration signal generating circuit 10, the clear terminal $CL_3$ being fed the output signal from the NOR gate 45, and the driver circuit 9 being fed the output signal from the output terminal $Q_3$.

Now, in a case where the induction heating apparatus of the present invention becomes operative by closing a switch (not shown), the oscillation start signal in the high level from the oscillation start signal circuit 330 is supplied to the clear terminal $CL_1$ of the D-flip flop 46 and the terminal D of the D-flip flop 11.

Hence, the clear terminal $CL_1$ of the D-flip flop 46 becomes the high level, and the output of the reset output terminal $\overline{Q}_1$ becomes the low level when the output signal $V_{OT}$ from the ON duration signal generating circuit 10 becomes the high level. When the ON duration signal generating circuit 10 generates the signal $V_{OT}$ for turning on the switching transistor 6, the drive circuit 9 turns on the switching transistor 6.

Meanwhile, the switching transistor 6 is turned off at the trailing edge of the output Va from the OR gate 31 to be decided by the setting value Pref of suitable input or the detection of the unsuitable load.

Figure 7:
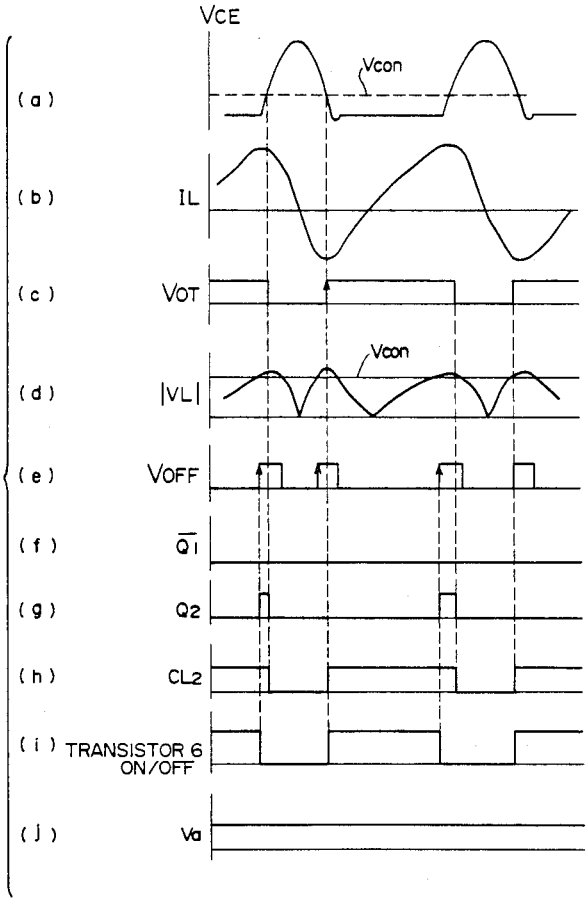
FIGS. 7(*a*)–(*j*) and 8(*a*)–(*j*) are waveform charts of signals of the third embodiment.
Figure 8:
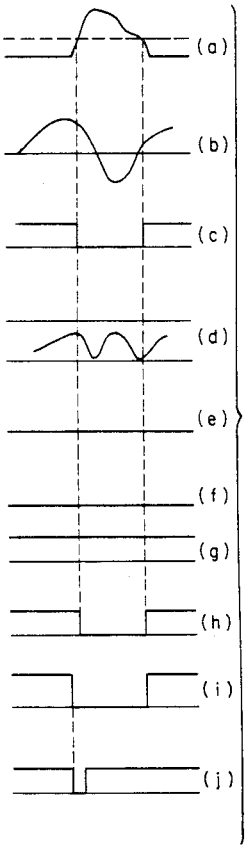

Now, FIGS. 7(*a*)–(*j*) and 8(*a*)–(*j*) are charts showing waveforms at the respective components of the third embodiment shown in FIG. 6, in which FIGS. 7(*a*)–(*j*) show a large setting value Pref of input power and FIGS. 8(*a*)–(*j*) show a small setting value.

FIGS. 7(*a*) and 8(*a*) show the terminal voltage $V_{CE}$ at the capacitor 5. At the timing of making $V_{CE}$ smaller than the positive terminal voltage Vcon at the filter capacitor 3, the output signal $V_{OT}$ from the ON duration signal generating circuit 10 rises as shown in FIGS. 7(*c*) and 8(*c*).

Waveforms of a current detected by the current transformer 17, that is, those of a current IL flowing through the induction heating coil 4, are shown in FIGS. 7(*b*) and 8(*b*). A signal |VL| corresponding to the full-wave-rectified current IL becomes a pulsating flow as shown in FIGS. 7(*d*) and 8(*d*). When a load current is excessive for some reason, the signal |VL| exceeds Vcon as shown in FIG. 7(*d*), at which time period the overcurrent signal $V_{OFF}$ becomes the high level.

Next, an explanation will be given on operations of the D-flip flops 47 and 11 for the above time period. The output signal $V_{OT}$ from the ON duration signal generating circuit 10, when at the high level, is fed to the clear terminal $CL_2$ of the D-flip flop 47 through the inverter circuit 43 and NOR gate 44, thereby releasing the D-flip flop 47 from being reset.

When the load current IL from inverter circuit 8 is an overcurrent due to an abnormality of the load or the like, the load current detecting voltage |VL| exceeds DC voltage Vcon, so that the overcurrent protection circuit 34 detects the overcurrent and the overcurrent signal $V_{OFF}$ becomes the high level as shown in FIG. 7(*e*).

The overcurrent signal $V_{OFF}$ is generated in the vicinity of the leading edge and trailing edge of voltage $V_{CE}$ (refer to FIG. 7(*a*)) of the capacitor 3 in the switching transistor 6. The overcurrent signal $V_{OFF}$ is fed to the CP terminal of D-flip flop 47 so that the CP terminal becomes the high level, and the set output terminal $Q_2$ of the same becomes the low level as shown in FIG. 7(*g*), the set output terminal $Q_3$ at the D-flip flop 11 is inverted to be the low level, and the switching transistor 6 is turned off by means of the first shot of overcurrent signal $V_{OFF}$ generated when the switching transistor 6 is on (see FIG. 7(*i*)), thereby blocking energization to the induction heating coil 4 and protecting the apparatus from being overheated.

Thereafter, when the output signal $V_{OT}$ changes to the low level, the output from the NOR gate 44, in other words, the terminal $CL_2$ of the flip flop 47 becomes the low level (see FIG. 7(*e*)), so that the D-flip-flop 47 is reset and its output $Q_2$ becomes the low level (refer to FIG. 7(*g*)).

Meanwhile, for the second shot of the overcurrent signal $V_{OFF}$ when the output signal $V_{OT}$ is at the low level, the D-flip flop 47 is kept reset because the reset terminal $CL_2$ thereof is at the low level, whereby the output $Q_2$ from D-flip flop 47, even when $V_{OFF}$ becomes the high level, holds the low level.

At this time, the reset terminal $CL_3$ at the D-flip flop 11 is at the high level and in the state of being released of the reset. Hence, when the output signal $V_{OT}$ becomes the high level, the D-flip flop 11 is set and the output $Q_3$ becomes the high level, thereby turning on the switching transistor 6. Also, the reset terminal $CL_2$ at the D-flip flop 47 becomes the high level to be released of the reset condition, whereby the D-flip flop 47 is put in condition of being prepared to receive the next signal $V_{OFF}$.

In brief, the inverter circuit 8, when the second shot of overcurrent signal $V_{OFF}$ is generated, can avoid a useless, inconvenient OFF control caused by the signal $V_{OFF}$, thereby enabling stable oscillation to be continued.

Alternatively, when the input power is small, since the load current detecting voltage |VL| is lower than the DC voltage Vcon as shown in FIGS. 8(*a*)–(*j*) the overcurrent is not detected as shown in FIGS. 8(*a*)–(*j*), thereby not causing inconvenience of uselessly turning off the switching element.

As this invention may be embodied in several forms without departing from the spirit of essential characteristics thereof, the present embodiment is therefore illustrative and not restrictive, since the scope of the invention is defined by the appended claims rather then by the description preceding them, and all changes that fall within metes and bounds of the claims, or equivalence of such metes and bounds thereof are therefore intended to be embraced by the claims.

What is claimed is:

1. An induction heating apparatus provided with an inverter circuit which is supplied with a DC voltage obtained by rectifying an alternating current and includes an induction heating coil and a switching element for causing a resonance current to flow through said induction heating coil, so that said switching element is turned on-off to allow said resonance current to flow through said induction heating coil, thereby heating a load magnetically coupled to said induction heating coil, comprising:

an input power detecting means for detecting a value of said alternating current;

an exciting current detecting means for detecting an exciting current in said inverter circuit;

an unsuitable load detecting means which compares the level of a signal corresponding to said value detected by said input power detecting means and a signal corresponding to said exciting current by said exciting current detecting means so as to thereby determine whether or not said load is suitable;

a rectifying circuit for full-wave-rectifying said exciting current and a bias circuit for biasing a voltage output by said rectifying circuit.

2. An induction heating apparatus as set forth in claim 1, wherein said exciting current flows through said switching element or a rectifying element connected in anti-parallel therewith.

3. An induction heating apparatus as set forth in claim 2, wherein said unsuitable load detecting means inhibits driving of said inverter circuit when said load is determined to be unsuitable by said unsuitable load detecting circuit.

4. An induction heating apparatus as set forth in claim 1, wherein said exciting current flows through said induction heating coil.

5. An induction heating apparatus as set forth in claim 4, wherein said unsuitable load detecting means inhibits driving of said inverter circuit when said load is determined to be unsuitable by said unsuitable load detecting circuit.

6. An induction heating apparatus as set forth in claim 1, wherein said unsuitable load detecting means inhibits driving of said inverter circuit when said load is determined to be unsuitable by said unsuitable load detecting circuit.

7. An induction heating apparatus providing with an inverter circuit which is supplied with a DC voltage obtained by rectifying an alternating current and includes an induction heating coil and a switching element for causing a resonance current to flow through said induction heating coil, so that said switching element is turned on-off to allow said resonance current to flow through said induction heating coil, thereby heating a load magnetically coupled to said induction heating coil, comprising:

an input power detecting means for detecting a value of said alternating current;

a coil current detecting means for detecting the current flowing through said induction heating coil;

an unsuitable load detecting means which compares the level of a signal corresponding to said value detected by said input power detecting means and a signal corresponding to said current detected by said coil current detecting means so as to thereby determined whether or not said load is suitable;

an ON duration signal generating means which compares a resonance voltage of said inverter circuit with a predetermined voltage so as to generate an ON duration signal defining the ON duration of said switching element;

a comparison means which compares a signal corresponding to a value of a full-wave-rectified current of said coil current with said predetermined voltage so as to generate an overcurrent signal when said signal corresponding to a value of said full-wave-rectified current of said coil current is larger than said predetermined voltage;

a logic circuit which associates said ON duration signal with said overcurrent signal to thereby on-off control said switching element;

and a rectifying circuit for full-wave-rectifying said coil current and a bias circuit for biasing a voltage output by said rectifying circuit;

wherein said logic circuit, in a case where said overcurrent signal is generated during said ON duration of said switching element, makes said switching element turn-off and, in all other cases, is irrelevant to the on-off control of said switching element.

8. An induction heating apparatus as set forth in claim 7, wherein said logic circuit includes a first flip flop which is set by said overcurrent signal and is reset by a dissipation of said ON duration signal.

9. An induction heating apparatus as set forth in claim 8, wherein said unsuitable load detecting means inhibits driving of said inverter circuit when said load is determined to be unsuitable by said unsuitable load detecting means.

10. An induction heating apparatus as set forth in claim 9, wherein said logic circuit includes a second flip flop which is set by said ON duration signal and is reset by the set output of said first flip flop or a signal output when said unsuitable load detecting means determines that said load is unsuitable.

11. An induction heating apparatus as set forth in claim 7, wherein said unsuitable load detecting means inhibits driving of said inverter circuit when said load is determined to be unsuitable by said unsuitable load detecting means.

* * * * *